US010113847B2

(12) United States Patent
Hwang et al.

(10) Patent No.: US 10,113,847 B2
(45) Date of Patent: Oct. 30, 2018

(54) ARM-FIRE DEVICE AND METHOD OF IGNITING PROPULSION SYSTEM USING THE SAME

(71) Applicants: Jungmin Hwang, Daejeon (KR); Seunggyo Jang, Daejeon (KR); Byungtae Ryu, Sejong-si (KR)

(72) Inventors: Jungmin Hwang, Daejeon (KR); Seunggyo Jang, Daejeon (KR); Byungtae Ryu, Sejong-si (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 15/490,435

(22) Filed: Apr. 18, 2017

(65) Prior Publication Data

US 2018/0058830 A1 Mar. 1, 2018

(30) Foreign Application Priority Data

Aug. 23, 2016 (KR) ..... 10-2016-0107036

(51) Int. Cl.
*F42C 11/00* (2006.01)
*F42C 15/24* (2006.01)
*F42C 11/04* (2006.01)

(52) U.S. Cl.
CPC ..... *F42C 11/00* (2013.01); *F42C 11/04* (2013.01); *F42C 15/24* (2013.01)

(58) Field of Classification Search
CPC .. F42B 3/18; F42C 15/00; F42C 15/24; F42C 15/40; F42C 19/00; F42C 11/00
See application file for complete search history.

(56) References Cited

U.S. PATENT DOCUMENTS 3,908,933 A * 9/1975 Goss ..... F02C 7/22 244/3.21
4,013,012 A * 3/1977 Giattino ..... F42C 15/40 102/216

(Continued)

FOREIGN PATENT DOCUMENTS

KR 1020000013618 A 3/2000
KR 1020000038951 A 7/2000

(Continued)

OTHER PUBLICATIONS

English Abstract of KR 20110125718 A, dated Nov. 22, 2011.
English Abstract of WO 0171272 A2, dated Sep. 27, 2001.

*Primary Examiner* — Benjamin P Lee
(74) *Attorney, Agent, or Firm* — Scully Scott Murphy and Presser; Frank Digiglio

(57) ABSTRACT

An arm-fire device comprises a capacitor charged by an arming signal; an acceleration switch for generating an operation signal if an acceleration more than a predetermined acceleration is sensed; a controller electrically connected with the capacitor and the acceleration switch, controlling generation of a firing signal; and a through bulkhead initiator provided with an ignition portion installed at a space separated by a bulkhead and configured to be electrically connected with the controller to ignite the ignition portion if the firing signal is transferred thereto, wherein the controller discharges the capacitor to generate the firing signal when the operation signal and a launching signal, which is applied from outside, are all sensed in a state that the capacitor is charged. The arm-fire device is applied to a multi-stage rocket, etc., whereby the probability of accidental ignition may be lowered.

16 Claims, 11 Drawing Sheets

(56) References Cited

U.S. PATENT DOCUMENTS 4,096,802 A * 6/1978 Waln ..... F42C 11/06 102/215
4,278,026 A 7/1981 Hibbs et al.
4,352,665 A * 10/1982 Kimble ..... F41A 33/02 434/22
4,592,281 A * 6/1986 Nagennast ..... F42C 15/18 102/200
4,653,400 A * 3/1987 Crawford ..... F42C 19/0819 102/202
4,660,472 A * 4/1987 Stevens ..... F42C 15/34 102/202.1
5,245,926 A * 9/1993 Hunter ..... F42C 15/40 102/207
5,959,236 A * 9/1999 Smith ..... F42C 19/0815 102/200
6,584,907 B2 * 7/2003 Boucher ..... B60R 21/017 102/202.5
7,987,787 B1 * 8/2011 Sudick ..... F42B 3/18 102/202.1
2006/0032310 A1 * 2/2006 Merassi ..... B81B 7/0048 73/514.35
2007/0204757 A1 9/2007 Teowee et al.
2009/0314174 A1 12/2009 Nelson et al.
2010/0237197 A1 * 9/2010 Rosenfield ..... A63H 27/005 244/138 R
2011/0030473 A1 * 2/2011 Acar ..... G01C 19/5712 73/504.12
2011/0308414 A1 12/2011 Sudick
2013/0055813 A1 * 3/2013 Bicknell ..... G01P 15/125 73/514.32

FOREIGN PATENT DOCUMENTS

KR 100279050B1 B1 1/2001
KR 20030003873 A 1/2003
KR 20030017148 A 3/2003
KR 100616019 B1 8/2006
KR 101199883 B1 11/2012

* cited by examiner

ARM-FIRE DEVICE AND METHOD OF IGNITING PROPULSION SYSTEM USING THE SAME

CROSS-REFERENCE TO RELATED APPLICATION

Pursuant to 35 U.S.C. § 119(a), this application claims the benefit of earlier filing date and right of priority to Korean Application No. 10-2016-0107036, filed on Aug. 23, 2016, the contents of which is incorporated by reference herein in its entirety.

BACKGROUND OF THE INVENTION

1. Field of the Invention

The present invention relates to an electronic arm-fire device for ignition of a propulsion system and a method of igniting the propulsion system using the same.

2. Description of the Conventional Art

An arm-fire device for a rocket is a device for preventing a guided missile from being accidently ignited and launched, and for launching a guided missile in accordance with a planned launching order when a required input condition is fulfilled. The arm-fire device for a rocket follows the design specifications of MIL-STD-1901A which is about the safety regulation of the ignition system of the propulsion system, and is generally provided with an initiator charged with gunpowder for rocket ignition.

The operation states of the arm-fire device include a safety state, an arming state, and an ignition state. Generally, the safety state is a state that no power source is supplied to the arm-fire device, and is electrically shorted and provided with a mechanical barrier for preventing ignition energy from being emitted to the outside of the arm-fire device even though the arm-fire device accidentally ignites.

The arming state means that a mechanical barrier is removed by an electric signal which is provided from outside, or can easily be removed by the operation of an initiator. Also, the arming state means that electric short of the initiator is released and thus an ignition power source can be provided from outside.

Finally, the firing state means that an initiator built in the arm-fire device is operated by the supply of an ignition signal at the arming state, and gas of high temperature and high pressure, which is ignition energy, is emitted to the outside of the arm-fire device.

Meanwhile, the arm-fire device may be categorized into a mechanical arm-fire device, an electromechanical arm-fire device (patent references 1 and 2), an electronic-mechanical arm-fire device (patent reference 3), or an electronic arm-fire device (patent reference 4) in accordance with a arming mode.

Since the electronic arm-fire device such as patent reference 4 does not use an actuator such as a solenoid or a torque motor for arming and has no mechanical bulkhead, it has an advantage that the electronic arm-fire device has a simple structure to enable miniaturization. Generally, a high voltage initiator aligned with an output ignition explosive is used to prevent accidental ignition at the safety state while satisfying MIL-STD-1901A. A general initiator is operated at 5 A or less, whereas the high voltage initiator is designed to ignite at 1000 A or more. Therefore, the accidental ignition of the high voltage initiator happens rarely.

Meanwhile, the electronic arm-fire device in the patent reference 4 has a built-in system for charging a capacitor through an arming signal that is supplied from outside. This system is preferably used for a single-stage arm-fire device of a multi-stage rocket, which is ignited on the ground, or an arm-fire device of a rocket which uses a hot launching system. On the other hand, if the electronic arm-fire device is used as an arm-fire device for two stages or more of a multi-stage rocket, or in case of a guided missile of a cold launching system, it is required that sensing the acceleration generated by the movement of the rocket should be used as an arming condition.

Under the need of such an acceleration sensing device, a component such as an acceleration switch manufactured in a manner of MEMS (Microelectromechanical System) is required to realize a small-scaled electronic arm-fire device. Particularly, in the acceleration switch applied to the arm-fire device for a rocket, the reliability of the acceleration switch for operation is very important. In more detail, the acceleration switch for sensing an acceleration should work stably, and should be manufactured favorably for repeated inspection. Also, the acceleration switch is required, which may precisely distinguish a normal input condition based on an injection acceleration of a rocket from an unexpected temporary impact.

Meanwhile, the arm-fire device for a rocket is exposed to high pressure and high heat of a combustion chamber after igniting a propulsion system of the rocket. In this case, a through bulkhead initiator (TBI) is required to maintain a structural airtightness. In the patent reference 4 according to the related art, an exploding foil initiator (EFI) which is a high voltage initiator is formed to be associated with the TBI. That is, the arm-fire device of the patent reference 4 is formed to be operated by the step of firing donor explosive of the TBI adjacent to the EFI in accordance with firing of the EFI based on high voltage. For the component configuration of the related art, there is a possibility to minimize the arm-fire device while maintaining reliability and safety of the operation.

Also, in configuring the electronic arm-fire device for a rocket, which includes an acceleration switch and a TBI, as described above, an operation mechanism and structure design are required, which can enhance reliability and safety while achieving miniaturization.

(Patent reference 1) U.S. Pat. No. 4,278,026 A
(Patent reference 2) US20090314174 A1
(Patent reference 3) US20070204757 A1
(Patent reference 4) US20110308414 A1

SUMMARY OF THE INVENTION

Therefore, the present invention has been devised to solve the aforementioned problems. The first object of the present invention is to provide an arm-fire device that adds a condition of an acceleration applied to a rocket to an ignition condition of an arm-fire device to lower the probability of accidental ignition of a rocket propulsion system.

The second object of the present invention is to provide an arm-fire device that is prevented from operating sensitively to an unexpected impact by controlling an acceleration switch insensitively to a reaction for sensing an acceleration.

The third object of the present invention is to provide an arm-fire device that operates more reliably by lowering the possibility of failing to sense an acceleration due to non-operation of a component of an acceleration switch.

The fourth object of the present invention is to provide an arm-fire device that can control the time when an acceleration switch senses an acceleration differently from the time when a signal for igniting a through bulkhead initiator is out.

The fifth object of the present invention is to provide an arm-fire device that can be manufactured in a smaller size by simplifying a configuration of a through bulkhead initiator.

The sixth object of the present invention is to provide an arm-fire device that reinforces airtightness of an ignition explosive installed in a through bulkhead initiator to ignite a propulsion system of a rocket, and facilitates the installation of the ignition explosive.

To achieve the first object of the present invention, an arm-fire device of the present invention comprises a capacitor charged by an arming signal; an acceleration switch for generating an operation signal when the acceleration is sensed more than a predetermined acceleration; a controller electrically connected with the capacitor and the acceleration switch, controlling the firing signal; and a through bulkhead initiator provided with an ignition portion installed in a space separated by a bulkhead and configured to be electrically connected with the controller to ignite the ignition portion if the firing signal is transferred thereto, wherein the controller discharges the capacitor to generate the firing signal when the operation signal and a launching signal, which is applied from outside, are all sensed in a state that the capacitor is charged.

The arm-fire device may further comprise a housing in which the controller, the capacitor and the acceleration switch are installed, wherein the through bulkhead initiator may be installed at one end of the housing to allow the space where the ignition portion is installed to be separated from the inside of the housing by the bulkhead.

The arm-fire device may further comprise a connector installed at the other end of the housing, performing at least one of transmission of the launching signal and supply of a power source.

To achieve the second object of the present invention, the acceleration switch of the arm-fire device according to the present invention includes a stator having a first contact point; a proof mass connected with the stator and formed to be movable with respect to the stator; a second contact point formed at one side of the proof mass and formed to contact the first contact point if the acceleration more than the predetermined acceleration is applied thereto; a plurality of first electrode plates formed to be protruded from the stator in a direction crossing a moving direction of the proof mass; and a plurality of second electrode plates formed to be protruded from the proof mass and arranged alternately with the first electrode plates along the moving direction of the proof mass.

The acceleration switch may further include an elastic member configured to connect the proof mass with the stator and apply an elastic force to the proof mass in a direction to space the second contact point apart from the first contact point.

Also, the acceleration switch may further include a power source portion for applying a voltage to each of the first and second electrode plates to allow the first and second electrode plates to have their respective polarities different from each other when performance of the acceleration switch is tested.

To achieve the third object of the present invention, the stator may be connected with a plurality of proof masses, the plurality of proof masses each having a plurality of second contact points, the stator includes a plurality of first contact points corresponding to the plurality of second contact points, and the operation signal is generated by an OR gate when at least one of the plurality of second contact points is in contact with at least one of the plurality of first contact points corresponding to the at least one of the plurality of second contact points.

To achieve the fourth object of the present invention, the operation signal is charged at a condenser connected to the OR gate, and the signal charged at the condenser is applied to a D flip-flop diode so as to be converted to a continuous signal.

Meanwhile, a portion where the first and second contact points are in contact with each other may be made of a metal material.

Also, the stator, the proof mass and the elastic member may be formed of the same material.

To achieve the fifth object of the present invention, the through bulkhead initiator of the arm-fire device according to the present invention includes an acceptor holder formed at the space where the ignition portion is provided; a donor holder separated from the acceptor holder by the bulkhead; a donor portion installed in the donor holder and provided with a low energy exploding foil initiator (LEFFI) fired by the firing signal; and an acceptor portion installed in the acceptor holder, and fired by receiving a shock wave due to firing of the donor portion through the bulkhead.

Also, the through bulkhead initiator may be provided with an insertion hole at a center thereof, into which the donor portion is inserted, and may further include an adaptor detachably formed in the donor holder by a spiral portion formed on an outer surface thereof, while the donor holder may be provided with a spiral on an inner side surface thereof for coupling with the spiral portion.

Meanwhile, the acceptor portion may be made of CH-6.

Furthermore, the through bulkhead initiator may be provided with a notch formed on at least one surface of both surfaces, and may further include a cover installed in the bulkhead to cover the ignition portion and configured to hermetically seal the ignition portion.

Also, the through bulkhead initiator may further include a detachment layer inserted between the acceptor portion and the ignition portion, and configured to prevent a reciprocal chemical reaction between the acceptor portion and the ignition portion.

To achieve the sixth object of the present invention, the through bulkhead initiator of the arm-fire device according to the present invention further includes an ignition portion case installed in the bulkhead, for inserting the ignition portion thereto.

The ignition portion case includes a cup portion formed to fill the ignition portion inside an opening formed at one side thereof; and a sealing portion for sealing the opening, wherein a notch may be formed at a part of outer surfaces of the ignition portion case.

Meanwhile, a method of igniting a propulsion system using an arm-fire device comprising a capacitor, an acceleration switch for sensing an acceleration of a launch vehicle, and a through bulkhead initiator fired to generate ignition energy by receiving electric energy, comprises a first step of charging the capacitor through an arming signal which is applied; a second step of generating an operation signal by sensing an input of an acceleration more than a predetermined acceleration through the acceleration switch when the launch vehicle is ejected; a third step of generating a firing signal by discharging the capacitor if a launching signal is applied in a state that the capacitor is charged and the operation signal is generated; and a fourth step of initiating combustion of a propulsion system of the launch vehicle as an ignition portion installed at the through bulkhead initiator is ignited by the firing signal.

According to the present invention configured by the aforementioned technical solutions, the following advantageous effects are obtained.

First of all, in a condition that the launching signal which is applied from outside and the operation signal transferred from the acceleration switch are applied at the same time, the firing signal is transmitted to the through bulkhead initiator, whereby the arm-fire device of the present invention may be used for propulsion of a cold launch type rocket or a multi-stage rocket. Also, since the arm-fire device of the present invention may prevent accidental ignition from occurring, the arm-fire device may assist a stable operation of the propulsion system of the rocket.

Secondly, as the first and second electrode plates are formed at each of the stator and the proof mass, the proof mass operates insensitively, whereby the acceleration switch which is not sensitive to an external impact may be provided. Also, chattering may be reduced, whereby the acceleration may be sensed exactly.

Also, the first and second electrode plates are provided with the power source portion, which can form a potential difference, whereby a test for on/off switching of the acceleration switch may be performed simply. Therefore, time and cost required for a performance test after manufacture of the acceleration switch may be saved.

Thirdly, a plurality of proof masses of the acceleration switch may respectively sense the acceleration, and the operation signal is output from at least one of the proof masses, whereby it is likely that the acceleration switch may be operated normally.

Fourthly, since the output of the operation signal output from the acceleration switch may be delayed or the time when the operation signal is generated may be controlled, occurrence time points and lengths of the acceleration signal and the firing signal may be set differently. A procedure of igniting the through bulkhead initiator by sensing the acceleration may be designed in various manners.

Meanwhile, since the first and second contact points where the stator and the proof mass are in contact with each other are formed of metal, durability of the acceleration switch may be improved.

Fifthly, as the donor portion of the through bulkhead initiator is made of a low energy exploding foil initiator (LEEFI) fired by electric energy, the donor portion may directly be fired by the firing signal formed by the controller and the capacitor. Simplification of the procedure of operating the through bulkhead initiator and device miniaturization may be realized.

Also, since the low energy exploding foil initiator (LEEFI) may be installed in the through bulkhead initiator by screw coupling, it may easily be separated from the through bulkhead initiator and tightly be coupled to the through bulkhead initiator.

Meanwhile, as the ignition portion of the through bulkhead initiator is sealed by the cover having a notch, the ignition portion may effectively transfer energy to the outside during firing even without being exposed to the external air.

Also, as the ignition portion of the through bulkhead initiator is separated from the acceptor portion by the detachment layer, an unexpected chemical reaction may be prevented from occurring.

Sixthly, as the ignition portion case to accommodate the ignition portion therein is provided, sealing of the ignition portion may be reinforced, and assembly of the ignition portion to the through bulkhead initiator may easily be performed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, an arm-fire device according to the present invention will be described in more detail with reference to the accompanying drawings.

It is to be understood that the singular expression used in this specification includes the plural expression unless defined differently on the context.

Also, in describing the embodiment disclosed in this specification, if detailed description of elements or functions known in respect of the present invention is determined to make the subject matter of the embodiment disclosed in this specification unnecessarily obscure, the detailed description will be omitted.

The accompanying drawings are only intended to understand the embodiment disclosed in this specification, and it is to be understood that technical spirits disclosed in this specification are not limited by the accompanying drawings, and the accompanying drawings include all modifications, equivalents or replacements included in spirits and scope of the present invention.

The arm-fire device according to the present invention is installed in a rocket, and includes an acceleration switch to sense an acceleration of the rocket. If an operation signal output from the acceleration switch and a launching signal applied from a guidance and control system are generated together, a controller outputs an electric firing signal to a through bulkhead initiator by using a power stored in a capacitor. The through bulkhead initiator serves to initiate a combustion reaction of the rocket as an ignition portion is ignited when a firing signal is received. Hereinafter, the arm-fire device according to the present invention will be described in detail with reference to the drawings.

Figure 1:
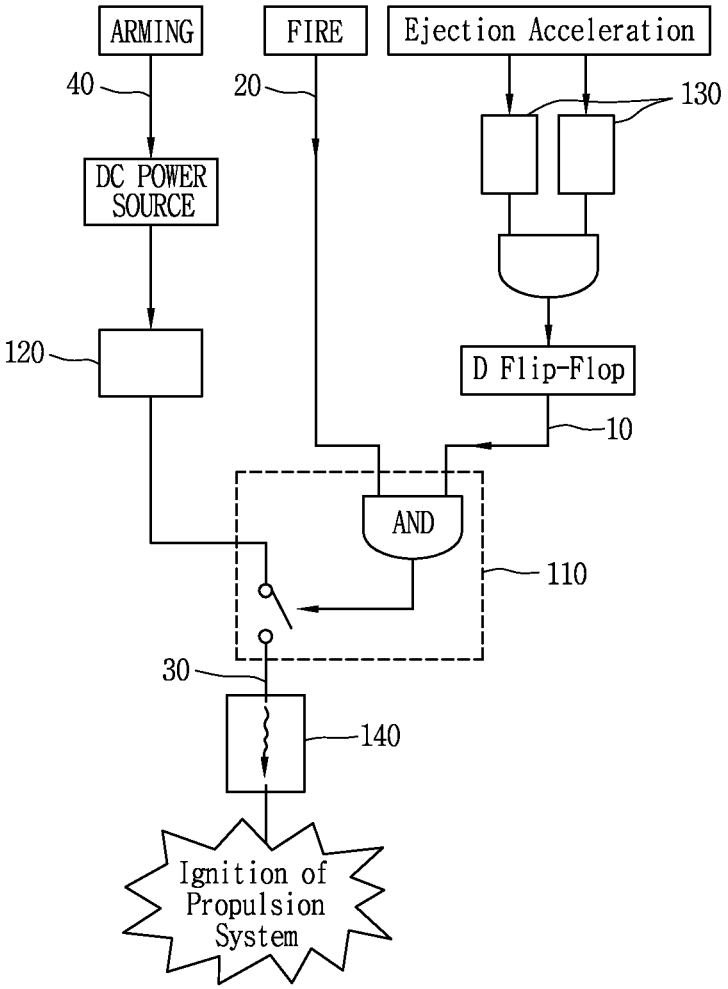
FIG. 1 is a schematic view illustrating a correlation between a signal input and an signal output among respective components of an arm-fire device according to the present invention.

FIG. 1 is a schematic view illustrating a correlation between a signal input and an signal output among respective components of an arm-fire device 100 according to the present invention. Referring to FIG. 1, the arm-fire device 100 according to the present invention includes a controller 110, a capacitor 120, an acceleration switch 130, and a through bulkhead initiator 140.

The controller 110 serves to control the operation of the arm-fire device 100 according to the present invention. In more detail, the controller 110 receives an operation signal 10 output by the acceleration switch 130 and a launching signal 20 applied from a guidance and control system, and outputs a firing signal 30, which is an electric signal, to the through bulkhead initiator 140. In this embodiment, the controller 110 is implemented as an electric circuit formed on a printed circuit board (PCB) to achieve miniaturization of the device.

Since the arm-fire device 100 according to the present invention is driven in an electronic mode, the firing signal 30 is transferred to the through bulkhead initiator 140 as an electrical signal. The capacitor 120 serves to store and supply the power to output an electric signal required to operate the through bulk head initiator 140 when the firing signal 30 is transferred by the controller 110.

The capacitor 120 is connected with a DC power source by an arming signal 40, whereby the capacitor 120 is charged. In the charged state of the capacitor 120, if the operation signal 10 of the acceleration switch 130 and the launching signal 20 by the guidance and control system are input to the controller 110, the capacitor 120 is discharged by the controller 110 to generate the firing signal 30. In this embodiment, the capacitor 120 may be installed on the PCB where the controller 110 is configured, to configure electric circuit connection with the controller 110. Also, the capacitor 120 may be charged with a high voltage sufficient to act as the firing signal 30 transferred to the through bulkhead initiator 140 which will be described later.

The acceleration switch 130 is a component that senses an acceleration of a rocket to output the operation signal to the controller 110, and the through bulkhead initiator 140 is a component that receives the firing signal 30 output from the controller 110 to ignite the rocket. Before description of the acceleration switch 130 and the through bulkhead initiator 140, a structure of the arm-fire device according to the present invention and components which constitute an external appearance of the arm-fire device will be described.

Figure 2A:
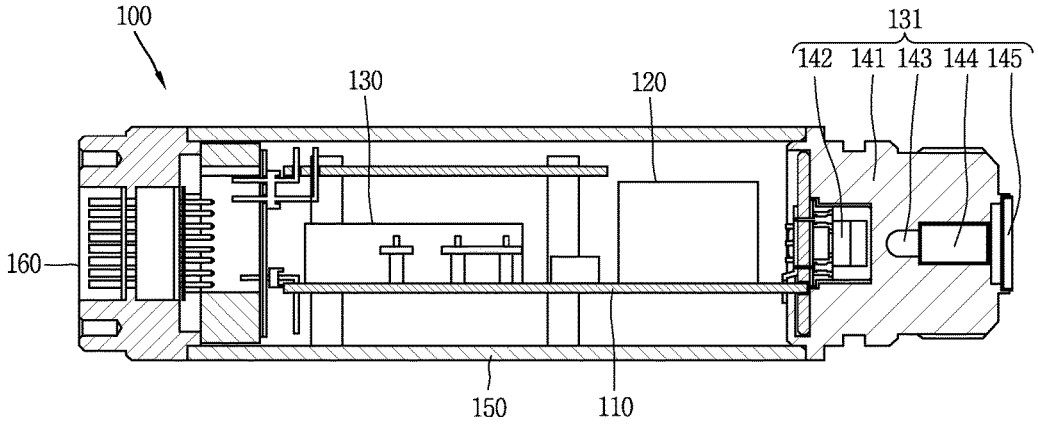
FIGS. 2A and 2B are a side view and a rear view illustrating an arm-fire device according to the present invention, respectively.
Figure 2B:
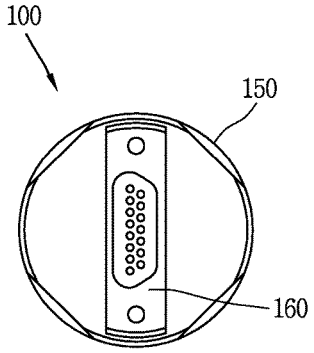

FIGS. 2A and 2B are a side view and a rear view of the arm-fire device according to the present invention. Referring to FIGS. 2A and 2B, the arm-fire device 100 according to the present invention may further include a housing 150 and a connector 160.

The housing 150 is a component which constitutes an external appearance of the arm-fire device 100 according to the present invention. In this embodiment, the housing 150 has a cylindrical shape. The controller 110, the capacitor 120 and the acceleration switch 130, which are described as above, may be installed inside the housing 150. In more detail, the controller 110, the capacitor 120 and the acceleration switch 130 may be installed on the PCB, or may be realized as a circuit on the PCB and fixed to an inner wall of the housing 150.

The through bulkhead initiator 140 is installed inside and outside one end of the housing 150. The through bulkhead initiator 140 serves to initiate (start) a combustion reaction of a propulsion system which exists outside the housing 150 by receiving the firing signal 30 from the controller 110 and the capacitor 120, which are installed inside the housing 150, and is installed to maintain airtightness of a combustion chamber of high temperature and high pressure during combustion of a rocket.

The connector 160 may be installed at the other end of the housing 150 of the arm-fire device 100 according to the present invention. The connector 160 may serve to supply a power source to the controller 110, the capacitor 120 and the acceleration switch 130, which are components installed inside the housing 150. Also, the connector 160 may serve to transmit the arming signal or the launching signal 20 of the rocket applied by the guidance and control system to the inside of the arm-fire device 100 according to the present invention.

A whole flow and structure of the signals of the arm-fire device 100 according to the present invention have been described as above. Hereinafter, a structure, an operation and effects of each of the acceleration switch 130 and the through bulkhead initiator 140 will be described in detail.

The arm-fire device 100 according to the present invention is characterized in that the operation signal 10 by the acceleration switch 130 is further applied in addition to the launching signal 20 applied by a guidance and control system or an external system, as a condition for operating the arm-fire device 100.

A cold launch guided missile is configured to ignite a rocket in the air after being ejected from a launching tube by an ejection system such as a gas generator. In this case, the acceleration switch 130 of the arm-fire device 100 according to the present invention may sense that the rocket has been ejected.

Alternatively, in case of a rocket propelled at a multi-stage, for combustion of the rocket of two or more stages, the acceleration switch 130 of the arm-fire device 100 according to the present invention may sense that a single-stage rocket is being combusted.

In this embodiment, the acceleration switch 130 is manufactured using the MEMS technology, whereby the acceleration switch 130 may be installed inside the housing 150 together with the controller 110 and the capacitor 120. As miniaturization is achieved by MEMS, the arm-fire device 100 does not become greater and thus may easily be applied to a small-scaled rocket, etc.

Figure 3:
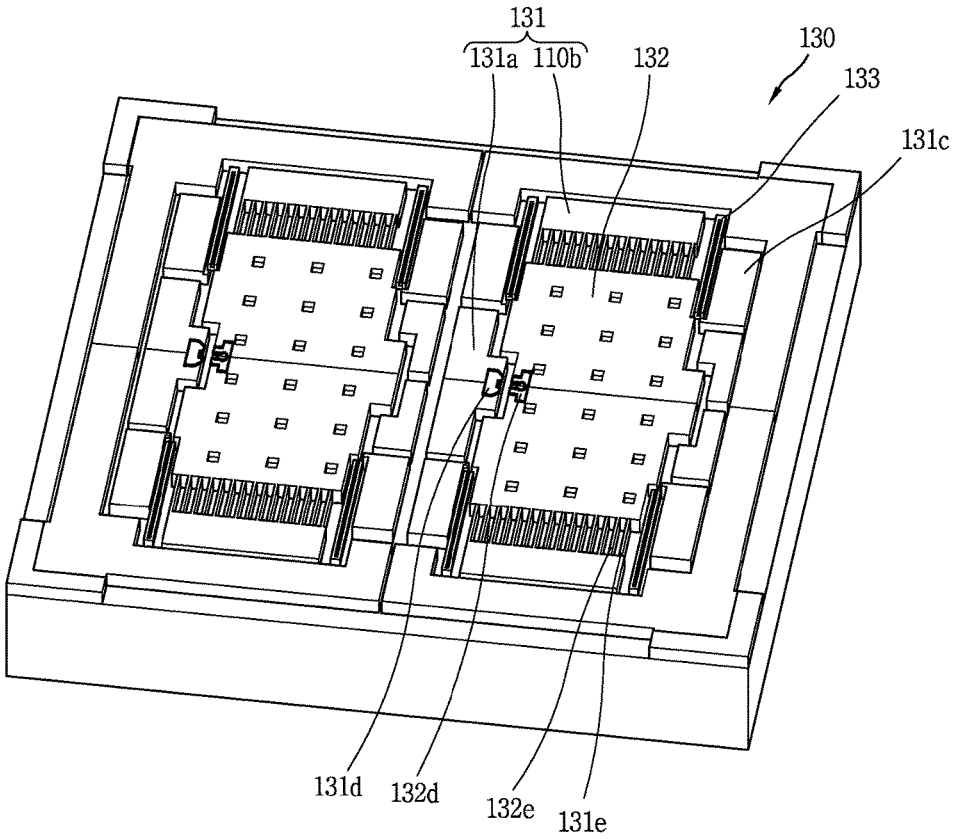
FIG. 3 is a perspective view illustrating an acceleration switch shown in FIG. 1.

FIG. 3 is a perspective view of the acceleration switch 130 of the arm-fire device 100 according to the present invention. Referring to FIG. 3, the acceleration switch 130 applied to the arm-fire device 100 according to the present invention includes a stator 131, a proof mass 132, and an elastic member 133.

The stator 131 forms an external appearance of the acceleration switch 130, and may be included in the arm-fire device 100 according to the present invention and installed to be fixed to a rocket. In this embodiment, the stator 131 may be installed to form electric and physical connection with the controller 110 formed on the PCB. The stator 131 may be formed to be provided with an inner space. Other components which constitute the acceleration switch 130 may be located in the inner space, and the stator 131 may protect the inner space so as to be separated from the outside. Therefore, the stator 131 may assist a stable operation of the acceleration switch 130.

The stator 131 may include a front portion 131*a*, side portions 131*b* and a fixed portion 131*c*. The front portion 131 may be arranged to adjoin a contact point of the proof mass 132, and the side portion 131*b* may be arranged to adjoin a side surface of the proof mass 132. Also, the fixed portion 131*c* may be arranged to adjoin a corner of the proof mass 132. Therefore, the front portion 131*a*, the side portions 131*b* and the fixed portion 131*c* may be configured to surround at least a part of a circumference of the proof mass 132.

The proof mass 132 serves to directly sense an acceleration from the acceleration switch 130 of the arm-fire device according to the present invention.

The proof mass 132 may be located at the inner space of the stator 131, and is installed to relatively move with respect to the stator 131. In more detail, the proof mass 132 may move in an opposite direction to an ejection direction of a rocket, as an inertial force is applied thereto when the rocket is ejected. Therefore, a relative position of the proof mass 132 with respect to the stator 131 which moves by being fixed to the rocket is changed, and a contact between the stator 131 and the proof mass 132 may be made.

The elastic member 133 serves to connect the stator 131 with the proof mass 132, and guides a displacement or a direction of movement based on an inertia force of the proof mass 132.

In more detail, the elastic member 133 may be formed such that one end thereof is connected with the fixed portion 131*c* of the stator 131 and the other end thereof is connected with the proof mass 132. In this embodiment, since the stator 131, the proof mass 132 and the elastic member 133 may be manufactured by an MEMS process that includes a deposition and an etching, the stator 131, the proof mass 132 and the elastic member 133 may be made of a single material. Also, if the proof mass 132 is formed in a rectangular shape, a plurality of elastic members 133 may respectively be formed at four corners.

Figure 4A:
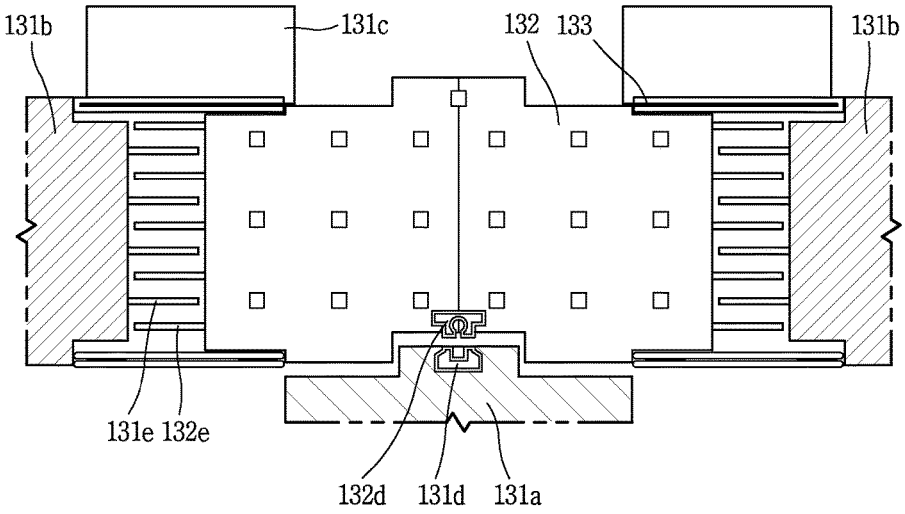
FIGS. 4A and 4B are conceptual views illustrating an operation of a proof-mass shown in FIG. 3.
Figure 4B:
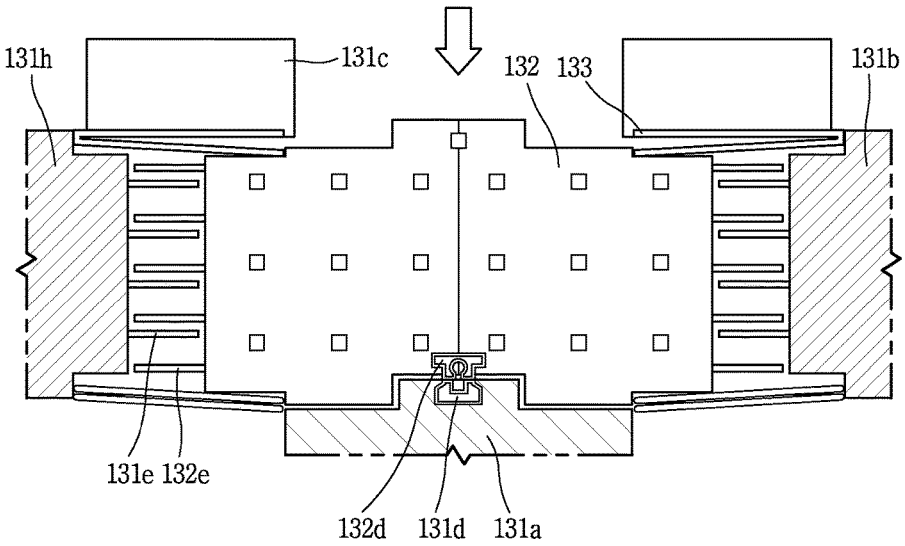

FIGS. 4A and 4B are conceptual views illustrating an operation of the proof-mass 132 shown in FIG. 3. Referring to FIGS. 4A and 4B, the operation of the stator 131, the proof mass 132 and the elastic member 133 may be seen when an acceleration more than a predetermined acceleration is sensed.

First of all, the predetermined acceleration may be a condition that an inertia force corresponding to an ejection acceleration of 10 g to 30 g of a rocket is applied to the proof mass 132. A direction of the predetermined acceleration applied to the proof mass 132 is an opposite direction to an ejection direction of the rocket, which is a downward direction in FIGS. 4A and 4B.

If the acceleration more than the predetermined acceleration is applied to the proof mass 132, the proof mass 132 moves to a contact position with the front portion 131*a* of the stator 131 as shown in FIG. 4B. At this time, an elastic force applied to the proof mass 132 due to the elastic member 133 may be designed as a value of the proof mass 132 that may contact the stator 131 by means of movement based on the predetermined acceleration.

Figure 5:
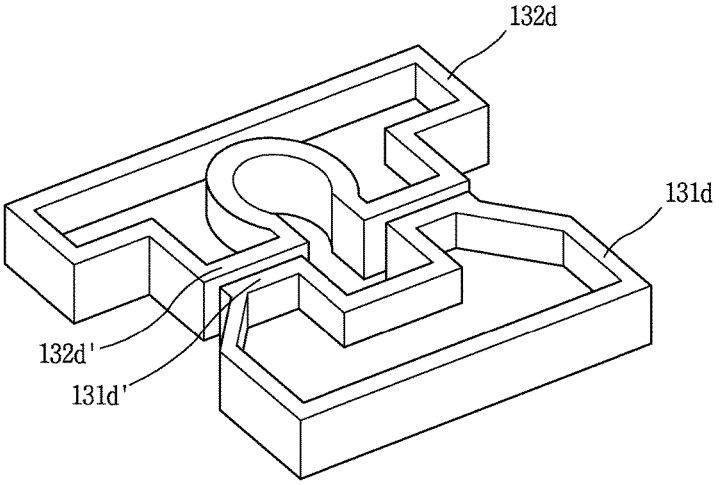
FIG. 5 is a conceptual view illustrating an enlarged state of first and second contact points shown in FIG. 3.

FIG. 5 is a conceptual view illustrating an enlarged state of the first and second contact points 131*d* and 132*d* shown in FIG. 3. When the stator 131 is in contact with the proof mass 132, the first and second contact points 131*d* and 132*d* respectively provided in the stator 131 and the proof mass 132 serve to configure electric connection for forming a signal of the acceleration switch 130.

In more detail, the first contact point 131*d* and the second contact point 132*d* are spaced apart from each other to face each other, and adjoin each other as the stator 131 and the proof mass 132 contact each other by input of an acceleration. Referring to FIG. 5, portions 131*d*' and 132*d*' where the first and second contact points adjoin each other may be formed to enable a surface contact.

The first and second contact points 131*d* and 132*d* may be made of a metal material to reduce a contact resistance when contacting each other. For example, the first and second contact points 131*d* and 132*d* may be formed of Ti and Au, or contact portions thereof may be plated with Ni. As the first and second contact points 131*d* and 132*d* are made of a metal material, structural intensity may be more improved than in a case where they are made of silicon. Therefore, an increase of abrasion and contact resistance due to repeated use may be prevented.

If the first contact point 131*d* and the second contact point 132*d* are in contact with each other in accordance with movement of the proof mass 132, an electric circuit of the acceleration switch 130 is closed, whereby the operation signal 10 which is an electric signal is generated. Also, after the stator 131 and the proof mass 132 are in contact with each other, if the predetermined acceleration condition is released, a restoring force of the elastic member 133 which has been deformed, may move the proof mass 132 so as to be spaced apart from the stator 131. At this time, since the first contact point 131*d* and the second contact point 132*d* are spaced apart from each other, the electric circuit of the acceleration switch 130 is opened, and the operation signal 10 is not generated any more.

As described above, as the elastic force provided by the elastic member 133 and the inertia force provided by the acceleration are together applied to the proof mass 132, an electric signal, which is turned on/off, may be generated exactly from the acceleration switch 130.

The acceleration switch 130 of the arm-fire device 100 according to the present invention may be configured such that first and second electrode plates 131*e* and 132*e* are respectively included in the stator 131 and the proof mass 132 as shown in FIGS. 4A and 4B. The first and second electrode plates 131*e* and 132*e* may assist a stable movement of the proof mass 132, and may also be used for a performance test of the first and second contact points 131*d* and 132*d*.

The second electrode plate 132*e* may be formed on a side surface of the proof mass 132. That is, the second electrode plate 132*e* may be formed to be protruded from the proof mass 132 in a direction crossing a moving direction of the proof mass 132. A plurality of second electrode plates 132*e* may be arranged to be spaced apart from each other at a predetermined interval.

In response to the second electrode plate 132*e*, the first electrode plate 131*e* may be formed to be protruded from the side portion 131*b* of the stator 131 that faces the side surface of the proof mass 132. That is, a plurality of first electrode plates 131*e* may be arranged among the plurality of second electrode plates 132*e*.

As a result, the first and second electrode plates 131*e* and 132*e* may be arranged alternately in parallel so as not to be directly in contact with each other in a state that no acceleration is applied to the acceleration switch 130.

As the second electrode plate 132*e* is formed to be protruded from the proof mass 132, air resistance may additionally be generated when the proof mass 132 moves, and the proof mass 132 may operate insensitively. Therefore, when an impact or an inertia force within millisecond is applied to the proof mass 132, an output of an on/off signal due to a sensitive reaction of the proof mass 132 may be prevented.

Also, as the proof mass 132 operates insensitively by the second electrode plate 132*e*, the first contact point 131*d* and the second contact point 132*d* are smoothly in contact with each other. Therefore, chattering generated from the acceleration switch 130 may be reduced. Furthermore, the number and a size of the first and second electrode plates 131*e* and 132*e* may be designed to satisfy a required chattering level.

Figure 6:
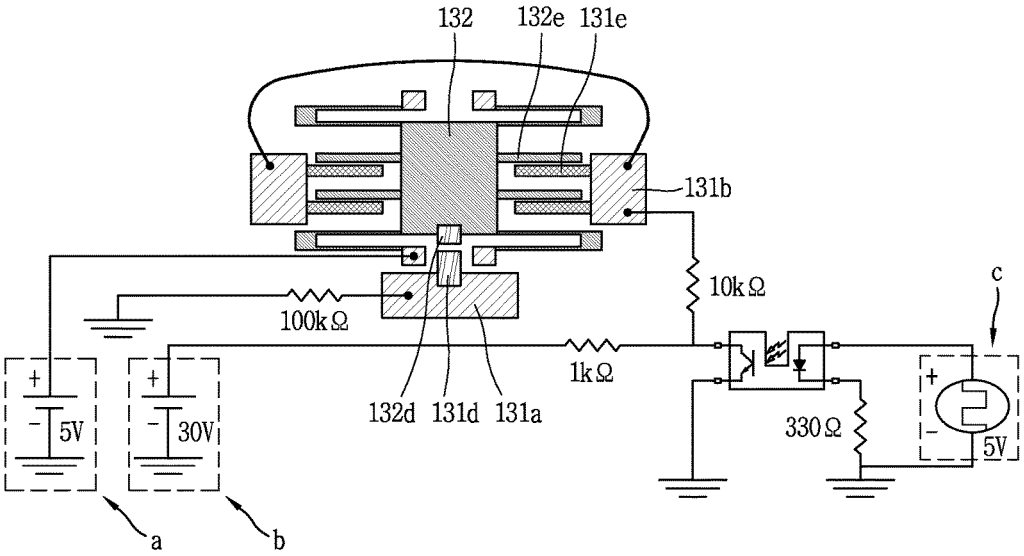
FIG. 6 is a circuit view illustrating that a test is performed as a voltage is applied to each of first and second electrode plates shown in FIG. 3.

Meanwhile, FIG. 6 is a circuit view illustrating that a test is performed as a voltage is applied to each of the first and second electrode plates 131*e* and 132*e* of the acceleration switch 130 installed in the arm-fire device according to the present invention. When performance of the acceleration switch 130 is tested, different voltages may be applied to the first and second electrode plates 131*e* and 132*e* such that the first and second electrode plates 131*e* and 132*e* may have their respective polarities different from each other.

If the voltage is applied to each of the first and second electrode plates 131*e* and 132*e*, an electrostatic field may be formed between the first and second electrode plates 131*e* and 132*e*, and if an electrostatic force is greater than the restoring force of the elastic member 133, the proof mass 132 may move. That is, even though there is no acceleration input, the proof mass 132 may move by means of the voltage applied to each of the first and second electrode plates 131*e* and 132*e*, whereby the first and second contact points 131*d* and 132*d* may be in contact with each other to output the operation signal 10.

Also, if the voltage applied to each of the first and second electrode plates 131*e* and 132*e* is interrupted (cut-off), the proof mass 132 returns to the initial position by means of the restoring force of the elastic member 133, and the first and second contact points 131*d* and 132*d* are spaced apart from each other, whereby the operation signal 10 is not output.

In this way, if the voltage is repeatedly applied to each of the first and second electrode plates 131*e* and 132*e* by quickly turning on/off, an on/off switching operation of the first and second contact points 131*d* and 132*d* may be tested repeatedly. That is, even though no inertial force is directly and physically applied to the acceleration switch 130 or the arm-fire device 100 according to the present invention, it is advantageous that switching performance of the first and second contact points 131*d* and 132*d* may be tested.

For example, if an application (on)-time of the voltage is set to 0.5 seconds and an off-time of the voltage is set to 0.5 seconds, tests of 600 times can be performed for 10 minutes. As shown in FIG. 6, the first and second electrode plates 131*e* and 132*e* may be driven using a voltage of 30V ('b') and a voltage of 5V ('c'), and a switching state of the first and second contact points 131*d* and 132*d* may be identified by using a DC signal of 5V ('a').

The acceleration switch 130 of the arm-fire device 100 according to the present invention may include a plurality of proof masses 132. If the acceleration switch 130 is operated through the plurality of proof masses 132, the operation signal 10 may be output more exactly.

In this embodiment, as shown in FIGS. 3, 4A and 4B, the stator 131 may be provided with a plurality of inner spaces, whereby the proof mass 132 may be installed in each of the inner spaces. The second contact point 132*d* may be provided in each of the plurality of proof masses 132, and the plurality of first contact points 131*d* corresponding to the second contact points 132*d* may be formed in the stator 131.

Figure 7:
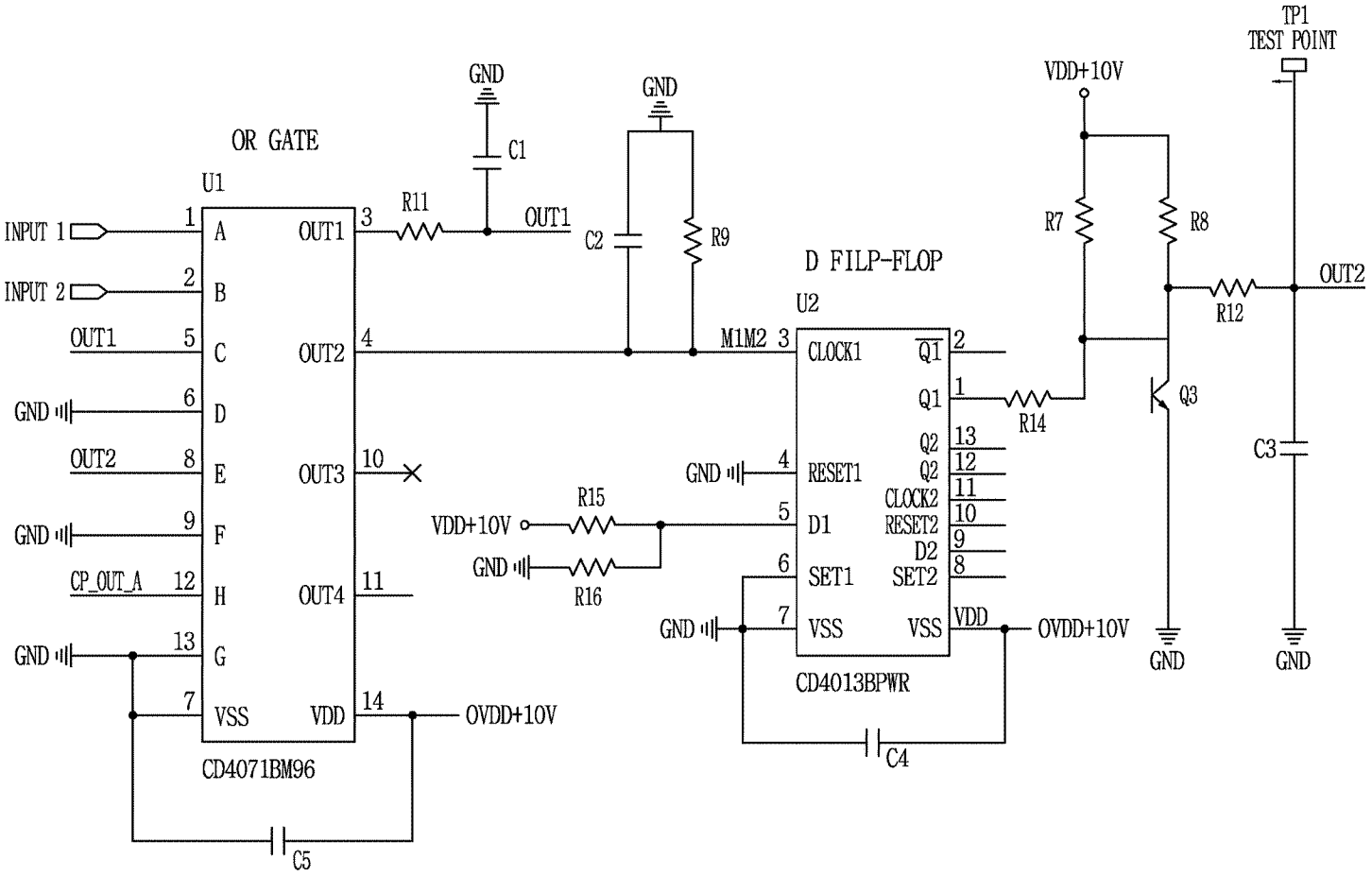
FIG. 7 is a circuit view illustrating a configuration of an OR gate and a D-Flip-Flop diode provided in the arm-fire device shown in FIG. 1.

FIG. 7 is a circuit view illustrating a configuration of an OR gate and a D-Flip-Flop diode provided in the arm-fire device 100 according to the present invention. Referring to FIG. 7, the first and second contact points 131*d* and 132*d* are formed in one pair by one proof mass 132, whereby switching signals generated from two pairs of the first and second contact points 131*d* and 132*d* are transferred to INPUT1 and INPUT2. The OR gate to which these signals are input is designed to generate the operation signal 10 of the acceleration switch 130 which senses and outputs a predetermined acceleration, even though contact and current flow are generated from only one pair of the two pairs of contact points.

Therefore, even though some of the plurality of proof masses 132 do not operate normally at the predetermined acceleration, the operation signal 10 may be output by a normal driving of other proof masses 132, and the acceleration switch 130 may more exactly sense the predetermined acceleration. As a result, reliability of the arm-fire device 100 according to the present invention may be ensured.

In the arm-fire device 100 according to the present invention, the operation signal 10 output from the acceleration switch 130 to the controller 110 may be transformed by the D Flip-Flop diode. The D Flip-Flop circuit serves to delay the output of the operation signal 10 or control the output time of the operation signal 10 by responding to the inertia force.

As shown in FIG. 7, an electric signal generated by a contact of the first and second contact points 131*d* and 132*d* may be charged in a condenser C1 having an appropriate time constant, and the signal charged in the condenser C1 may again be connected to CD4013BPRW which is the D Flip-Flop diode. At this time, the condenser C1 may be connected to the aforementioned OR gate, whereby at least one electric signal input from the plurality of proof masses 132 may be charged in the condenser.

Through addition of the D Flip-Flop diode, if the first and second contact points 131*d* and 132*d* maintain a contact state for a time period set to sense an ejection acceleration, the operation signal 10 may be generated by means of the acceleration switch 130 and then transferred to the controller 110.

For example, in a state that the ejection acceleration is generated for 100 msec, if contact and current flow of the first and second contact points 131*d* and 132*d* are generated for a time period of 75%, the arm-fire device 100 according to the present invention may be set to sense the contact and current flow as a normal ejection launching. This may be realized by controlling R-C values R11 and C1 of the D Flip-Flop circuit to have a time constant of 75 msec. Therefore, when the acceleration switch 130 maintains the contact and current flow state for a minimum 75 msec, the operation signal 10 may be generated continuously by the D Flip-Flop diode, and the operation signal 10 may be regarded as a reference for determining a normal ejection launching.

Figure 8:
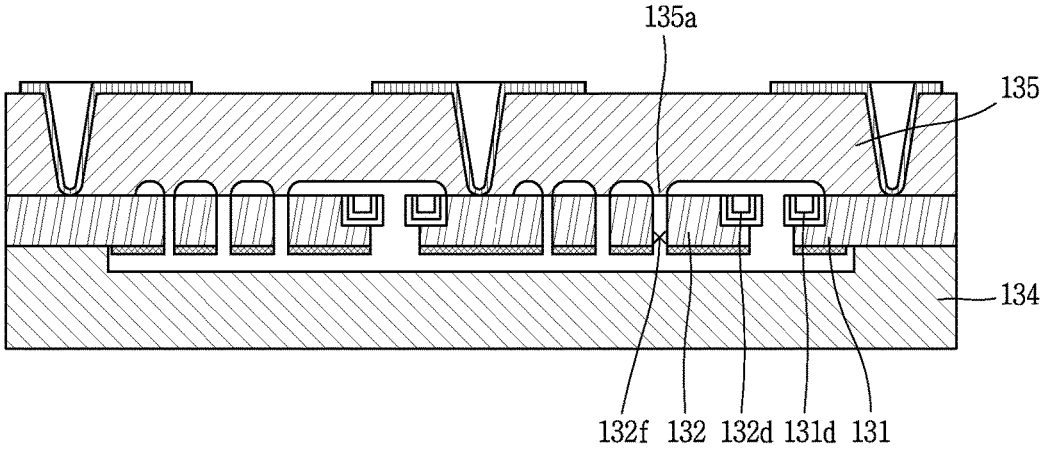
FIG. 8 is a cross-sectional view illustrating an acceleration switch shown in FIG. 3.

FIG. 8 is a cross-sectional view of the acceleration switch 130 provided in the arm-fire device 100 according to the present invention. Referring to FIG. 8, the acceleration switch 130 of the arm-fire device 100 according to the present invention may further include a base glass 134 and a cup glass 135. The base and cup glasses 134 and 135 may serve to prevent a malfunction or damage from occurring by restricting a displacement of the proof mass 132.

The base and cup glasses 134 and 135 may respectively be located below and above the proof mass 132 and coupled to the stator 131 to form a space therein. Also, in this embodiment, the cup glass 135 may be provided with a protrusion 135*a* formed to be protruded toward the proof mass 132. Especially, the protrusion 135*a* may be formed to be caught in a groove 132*f* formed at the proof mass 132.

The base and cup glasses 134 and 135 may reduce the possibility that the acceleration switch 130 may be damaged by impact during drop. Particularly, if the proof mass 132 moves by means of impact applied to a direction vertical to a substrate and receives a stress that exceeds a yield strength of the elastic member 133, the base and cup glasses 134 and 135 may prevent the elastic member 133 from being damaged. Also, the protrusion 135*a* is caught in the groove 132*f*, the cup glass 135 may stably support the proof mass 132 without moving on the proof mass 132.

The detailed configuration, operation and effects of the acceleration switch 130 included in the arm-fire device 100 according to the present invention have been described as above. Hereinafter, the through bulkhead initiator 140 configured to initiate combustion of a rocket by receiving the firing signal 30 by means of the controller 110 will be described.

Since at least a part of the arm-fire device for a rocket is installed to be exposed to a combustion chamber of the rocket and ignites a propulsion system, the arm-fire device is exposed to high pressure and heat of the combustion chamber. In this case, if a structural sealing state of the combustion chamber is destroyed through the arm-fire device, other component of the rocket is damaged or combustion efficiency is deteriorated. The through bulkhead initiator (TBI) is used to solve such a problem, and operates by firing explosive in such a way to separate a space for receiving a signal from a space for performing ignition of the combustion chamber through a bulkhead, and transfer a shock wave through the bulkhead.

Figure 9:
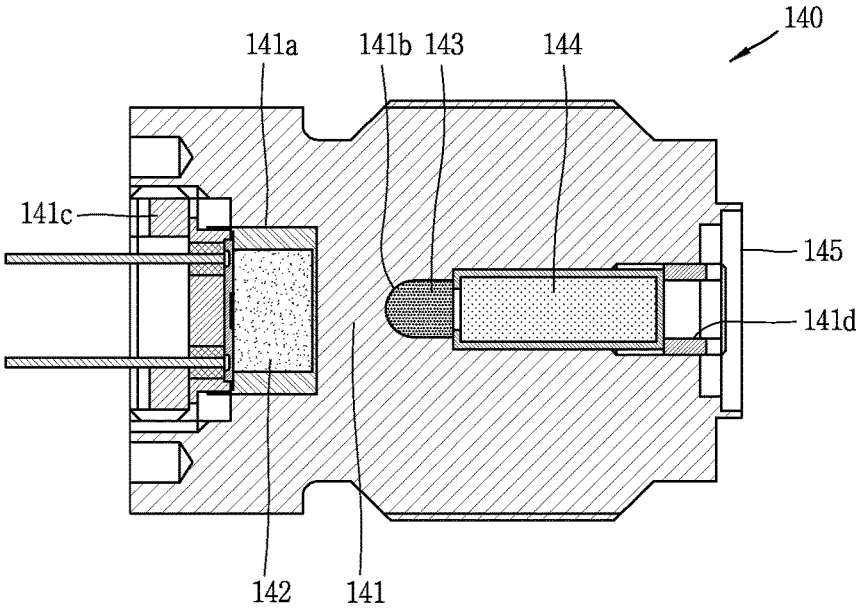
FIG. 9 is a cross-sectional view illustrating one embodiment of a through bulkhead initiator shown in FIG. 1.

FIG. 9 is a cross-sectional view illustrating one embodiment of the through bulkhead initiator 140 included in the arm-fire device 100 according to the present invention. Referring to FIG. 9, the through bulkhead initiator 140 includes a bulkhead 141, a donor holder 141*a* and an acceptor holder 141*b*, which are separated from each other by the bulkhead 141, a donor portion, an acceptor portion 143, and an ignition portion 144.

The bulkhead 141 is formed to physically separate the donor holder 141*a* from the acceptor holder 141*b*. Also, the bulkhead 141 may serve as a support structure for respectively installing and supporting the donor portion provided inside the donor holder 141*a* and the acceptor portion 143 provided inside the acceptor holder 141*b*.

The donor portion provided inside the donor holder 141*a* is a component fired by receiving the firing signal 30 from the controller 110.

The arm-fire device 100 according to the present invention is configured to generate firing in an electronic mode, and the firing signal 30 input to the donor portion is an electric signal by the power charged in the capacitor 120.

The donor portion of the through bulkhead initiator 140 provided in the present invention may be implemented as a low energy exploding foil initiator (LEEFI) 142 operated when a high voltage is applied thereto.

A donor portion of the related art through bulkhead initiator is configured to be fired by explosive, and is configured to fire an exploding foil initiator, which is a high voltage initiator, through energy transferred by an electric circuit, and to fire the explosive of the donor portion by means of the EFI.

On the other hand, the through bulkhead initiator 140 of the present invention is configured to electrically fire the low energy exploding foil initiator (LEEFI) 142, which is the donor portion, by means of electric energy of a high voltage formed through the controller 110 and the capacitor 120, and to transfer the firing of the donor portion to the acceptor portion 143 of the acceptor holder 141*b* through the bulkhead 141.

At this time, the low energy exploding foil initiator (LEEFI) 142 is operated at a voltage lower than that of the related art EFI, and for example, may be fired if a voltage of 1000V or more is applied thereto.

As a result, since the donor portion of the through bulkhead initiator 140 of the present invention does not include explosive, it is advantageous that the arm-fire device of the present invention is simpler than the related art arm-fire device and may be configured in a small size.

Also, the low energy exploding foil initiator (LEEFI) 142 is applied to the donor portion of the through bulkhead initiator 140 of the present invention, whereby the arm-fire device of the present invention may be operated at a voltage lower than that of the related art arm-fire device. Therefore, since capacity of the capacitor 120 may be reduced, the arm-fire device 100 of the present invention may be miniaturized.

Figure 10A:
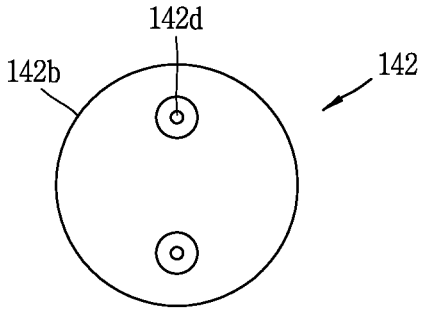
FIGS. 10A and 10B are a front view and a cross-sectional view of a low energy exploding foil initiator (LEEFI) shown in FIG. 9.
Figure 10B:
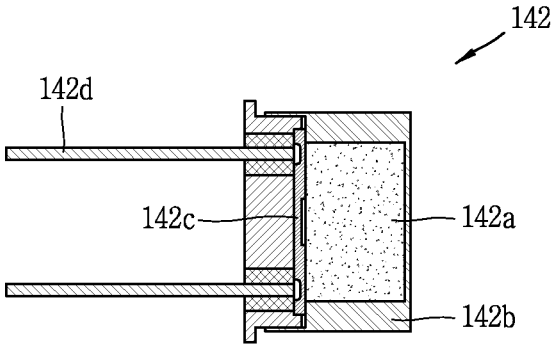

FIG. 10A is a front view of the low energy exploding foil initiator (LEEFI) 142 applied to the through bulkhead initiator 140 shown in FIG. 9, and FIG. 10B is a cross-sectional view of the low energy exploding foil initiator (LEEFI) 142 applied to the through bulkhead initiator 140 shown in FIG. 9. Hereinafter, one embodiment to mount the low energy exploding foil initiator (LEEFI) 142 to the through bulkhead initiator 140 will be described with reference to FIGS. 10A and 10B together with FIG. 9.

The low energy exploding foil initiator (LEEFI) 142 includes a high voltage firing material 142*a*, and a cup-shaped case 142*b* is formed to surround the high voltage initiator 142*a*. Also, a bridge 142*c* is installed to hermetically seal the case 142*b*, and a plug 142*d* formed to fire the high voltage firing material 142*a* by receiving the firing signal 30 from the outside is installed to pass through the bridge 142*c*.

Meanwhile, the low energy exploding foil initiator (LEEFI) 142 may be installed in the donor holder 141*a* by a donor fixing nut 141*c* formed to be coupled to the donor holder 141*a* as shown in FIG. 9. The donor fixing nut 141*c* may be provided with a cavity through which the plug 142*d* passes.

Figure 11:
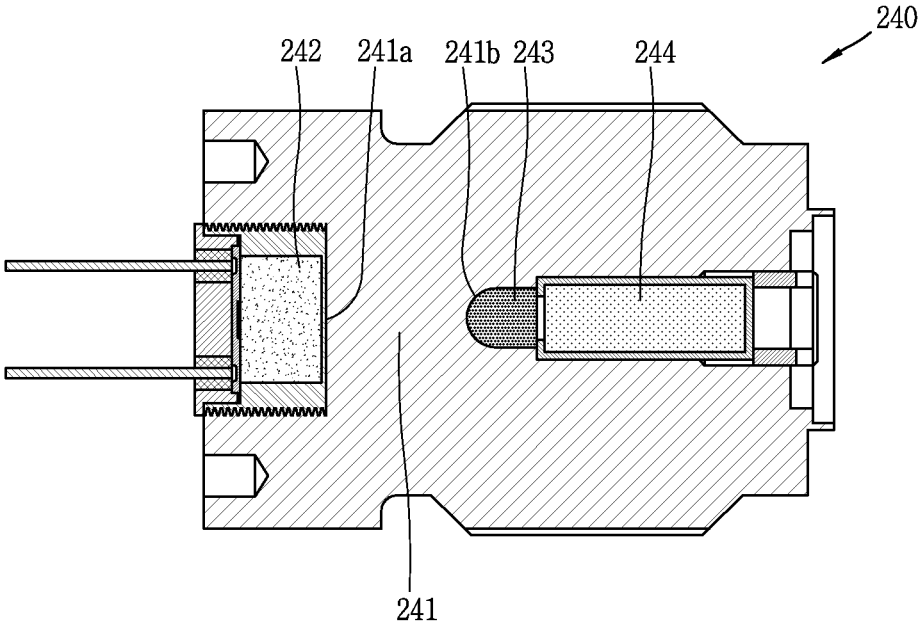
FIG. 11 is a cross-sectional view illustrating another embodiment of a through bulkhead initiator shown in FIG. 1.
Figure 12A:
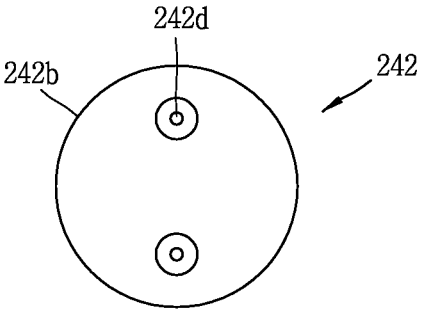
FIGS. 12A and 12B are a front view and a cross-sectional view of a low energy exploding foil initiator (LEEFI) shown in FIG. 11.
Figure 12B:
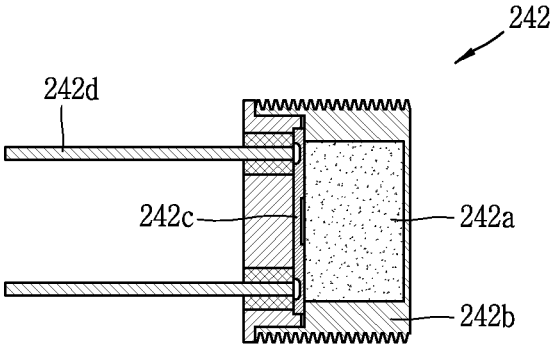

FIG. 11 is a cross-sectional view illustrating another embodiment of a through bulkhead initiator 240 of the present invention. FIGS. 12A and 12B are a front view and a cross-sectional view of a low energy exploding foil initiator (LEEFI) 242 included in the through bulkhead initiator 240 shown in FIG. 11. Another embodiment of the low energy exploding foil initiator (LEEFI) 242 that forms a donor portion will be described with reference to FIGS. 12A and 12B together with FIG. 11.

In this embodiment, the through bulkhead initiator 240 includes a donor holder 241*a* and an acceptor holder 241*b*, which are formed by a bulkhead 241. The low energy exploding foil initiator (LEEFI) 242 that forms a donor portion includes an adaptor 242*b* that is detachably formed. The adaptor 242*b* is provided with a high voltage firing material 242*a* therein, and is provided with a spiral portion on an outer side surface thereof. Similar to one embodiment described above, the low energy exploding foil initiator (LEEFI) 242 includes a bridge 242*c* and a plug 242*d*. An acceptor 243 and an igniter 244 are located at the acceptor holder.

A spiral is formed at an inner side surface of the donor holder 241*a* of the through bulkhead initiator 240 according to this embodiment, whereby the spiral may be coupled to the spiral portion of the adaptor.

According to another embodiment of the low energy exploding foil initiator (LEEFI) 242 of the present invention, the low energy exploding foil initiator (LEEFI) 242 may be installed in the donor holder 241*a* in a screw coupling manner, whereby it is advantageous that a stable coupling may be performed with a facilitated assembly process.

The acceptor portion 143 of the through bulkhead initiator 140 included in the arm-fire device 100 according to the present invention serves to ignite the ignition portion 144 by receiving a shock wave due to firing of the aforementioned donor portion through the bulkhead 141.

The acceptor portion 143 is installed in the acceptor holder 141*a* separated from the aforementioned donor portion by the bulkhead 141.

An explosive of CH-6 suitable for a safety regulation of an arm-fire device for a propulsion system may be applied to the acceptor portion 143. CH-6 is an insensitive explosive, and is less likely to be fired accidentally if an abnormal impact is applied, whereby stability of the through bulkhead initiator may be improved.

The ignition portion 144 of the through bulkhead initiator 140 of the present invention is a component that serves to ignite a propulsion system of a rocket. That is, ignition energy generated by firing of the explosive of the ignition portion 144 is emitted to the outside through a side which is not sealed by the bulkhead 141, and then transferred to the propulsion system.

In this embodiment, one side of the ignition portion 144 may be arranged to adjoin the acceptor portion 143, and the other side of the ignition portion 144 may be arranged toward the outside of the through bulkhead initiator 140.

In this embodiment, the explosive of the ignition portion 144 may be made of $BKNO_3$. However, if $BKNO_3$ is exposed to the air for a long time, a surface of corned explosive is oxidized, whereby combustion is not performed normally and thus performance of the ignition portion 144 may be deteriorated.

The through bulkhead initiator 140 of the present invention may further include a cover 145 to prevent the ignition portion 144 from being exposed out. The cover 145 may be formed to cover the ignition portion 144 to allow the ignition portion 144 to be sealed from the outside.

That is, as shown in FIG. 9, an ignition portion fixing nut 141 for fixing the ignition portion 144 is installed at a side where the ignition portion 144 is externally exposed, and the cover 145 may be formed at an end of the ignition portion 144 to cover the ignition portion 144.

Figure 13:
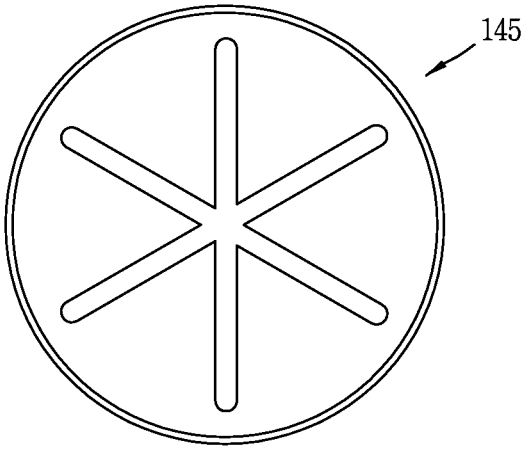
FIG. 13 is a front view of a cover shown in FIG. 9.

However, since the cover 145 should easily be destroyed by firing of the ignition portion 144, a notch may be formed on at least one surface of the cover 145. FIG. 13 is a front view of the cover 145 shown in FIG. 9. In this embodiment, the notch may be formed in an asterisk shape.

The cover 145 that seals the ignition portion 144 from the outside may minimize a contact of the ignition portion 144, which includes $BKNO_3$, with the air. On the other hand, when the ignition portion 144 is combusted normally, gas of high temperature and high pressure may be emitted to the outside well by the notch provided in the cover 145.

Meanwhile, the acceptor portion 143 and the ignition portion 144 of the through bulkhead initiator 140 may be made of different kinds of explosive components. In some cases, an unexpected result may be generated by a chemical reaction between the different explosive components.

To handle the unexpected result, a detachment layer may be arranged between the acceptor portion 143 and the ignition portion 144. The acceptor portion 143 and the ignition portion 144 may be separated from each other by the detachment layer, whereby the possibility of an unexpected reaction may be excluded. Furthermore, it is possible to combine the explosive components of the acceptor portion 143 and the ignition portion 144 more variously.

The through bulkhead initiator 140 of the arm-fire device 100 according to the present invention may further include an ignition portion case 146. The ignition portion case 146 may serve to facilitate an assembly of the ignition portion 144 and to stably protect the ignition portion 144.

Figure 14A:
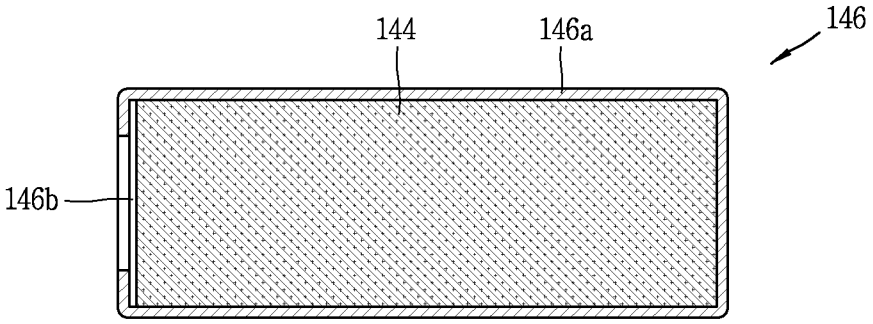
FIG. 14A is a cross-sectional view of an ignition portion case shown in FIG. 9.
Figure 14B:
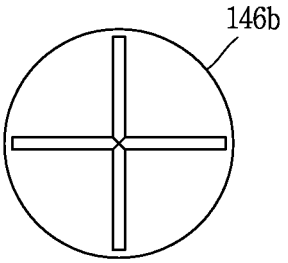
FIG. 14B is a front view of a sealing portion which constitutes an ignition portion case shown in FIG. 9.

FIG. 14A is a cross-sectional view of the ignition portion case 146 shown in FIG. 9, and FIG. 14B is a front view illustrating a sealing portion 146*b* which constitutes the ignition portion case 146 shown in FIG. 9.

The ignition portion case 146 includes a cup portion 146*a* formed to fill the ignition portion 144 through an opening formed at one side thereof, and a sealing portion 146*b* formed to seal the opening. The ignition portion case 146 may be made of various materials, for example, metal such as Cu or Al having a thin thickness of about 0.2 mm.

Also, a notch may be formed on an outer surface of the ignition portion case 146 to easily emit combusted gas to the outside when the ignition portion 144 is fired.

As the ignition portion case 146 is provided, an explosive material of the ignition portion 144 may be prevented from being denaturalized by reaction with moisture or the acceptor portion 143. Particularly, if the ignition portion case 146 is installed together with the aforementioned detachment layer and the cover 145, the ignition portion 144 may doubly be sealed to be protected more stably.

Also, together with the notch formed in the aforementioned cover 145, the notch formed in the ignition portion case 146 may also assist emission of the combusted gas to the outside during firing of the ignition portion 144.

Meanwhile, the ignition portion case 146 may be manufactured in various manners. For example, the ignition portion case 146 may be manufactured in such a manner that the ignition portion 144 is inserted into the cup portion 146*a* and then sealed through a crimping process for pressurizing an upper part of the cup portion 146*a* in a state that an opening is covered by the sealing portion 146*b*.

The aforementioned arm-fire device 100 according to the present invention is installed in a launch vehicle such as a multi-stage rocket or a cold launch rocket and serves to ignite a propulsion system. A procedure of initiating combustion of the propulsion system through the arm-fire device according to the present invention is performed as follows.

First of all, the capacitor 120 is charged by an arming signal 40 which is applied from the outside. The capacitor 120 may be charged by a DC power source, etc., and may be charged with a voltage sufficient to fire the low energy exploding foil initiator (LEEFI) 142 of the through bulkhead initiator 140.

Next, the acceleration switch 130 senses an acceleration generated from the launch vehicle to generate an operation signal 10. The acceleration is generated by a force applied from the outside of the launch vehicle in case of a cold launch rocket, and is generated by rocket propulsion of a previous stage in case of a multi-stage rocket.

If a launching signal 20 is applied from the outside while the operation signal 10 is being generated, the capacitor 120 is discharged. A current flow due to the discharge of the capacitor 120 forms a firing signal 30. That is, the firing signal 30 is generated when charging of the capacitor 120, generation of the operation signal 10, and input of the launching signal 20 have been performed.

Finally, the firing signal 30 starts combustion of the propulsion system by igniting the ignition portion 144 of the through bulkhead initiator 140. In more detail, the firing signal 30 fires the low energy exploding foil initiator (LEEFI) 142 of the through bulkhead initiator 140, and a shock wave generated at this time is transferred to the acceptor portion 143 through the bulkhead 141, whereby the acceptor portion 143 is fired. The ignition portion 144 is fired by the firing of the acceptor portion 143, and ignition energy due to the firing of the ignition portion 144 is emitted to the outside.

The foregoing embodiments and advantages of the arm-fire device and the method of igniting the propulsion system using the same according to the present invention are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An arm-fire device comprising:

a capacitor charged by an arming signal;

an acceleration switch for generating an operation signal if an acceleration more than a predetermined acceleration is sensed;

a controller electrically connected with the capacitor and the acceleration switch, controlling generation of a firing signal by discharging the capacitor when the operation signal and an externally-applied launching signal are all sensed in a state that capacitor is charged; and a through bulkhead initiator provided with an ignition portion installed at a space separated by a bulkhead and configured to be electrically connected with the controller to ignite the ignition portion if the firing signal is transferred thereto, wherein the acceleration switch includes:

a stator having a first contact point;

a proof mass accommodated within the stator and supported by an elastic member to be movable with respect to the stator;

a second contact point formed at one side of the proof mass and formed to contact the first contact point if the acceleration more than the predetermined acceleration is applied thereto;

a plurality of first electrode plates formed to be protruded from the stator in a direction crossing a moving direction of the proof mass;

a plurality of second electrode plates formed to be protruded from the proof mass and thus arranged alternately with the first electrode plates along the moving direction of the proof mass;

a base glass coupled to a lower portion of the stator to cover a lower portion of the proof mass; and a cup glass coupled to an upper portion of the stator to cover an upper portion of the proof mass, wherein a protrusion protrudes from the cup glass toward a groove formed at the upper portion of the proof mass to be caught in the groove, such that the cup glass and the base glass restrict a displacement of the proof mass.

2. The arm-fire device according to claim 1, further comprising a housing in which the controller, the capacitor and the acceleration switch are installed, wherein the through bulkhead initiator is installed at one end of the housing to allow the space where the ignition portion is installed to be separated from the inside of the housing by the bulkhead.

3. The arm-fire device according to claim 2, further comprising a connector installed at the other end of the housing, performing at least one of transmission of the launching signal and supply of a power source.

4. The arm-fire device according to claim 1, wherein the acceleration switch further includes an elastic member is configured to connect the proof mass with the stator and apply an elastic force to the proof mass in a direction to space the second contact point apart from the first contact point.

5. The arm-fire device according to claim 1, wherein the acceleration switch further includes a power source portion for applying a voltage to each of the first and second electrode plates to allow the first and second electrode plates to have polarities different from each other when performance of the acceleration switch is tested.

6. The arm-fire device according to claim 1, wherein the stator is connected with a plurality of proof masses, the plurality of proof masses each having a plurality of second contact points, the stator includes a plurality of first contact points corresponding to the plurality of second contact points, and the operation signal is generated by an OR gate when at least one of the plurality of second contact points is in contact with at least one of the plurality of first contact points corresponding to the at least one of the plurality of second contact points.

7. The arm-fire device according to claim 6, wherein the operation signal is charged at a condenser connected to the OR gate, and the signal charged at the condenser is applied to a D flip-flop diode so as to be converted to a continuous signal.

8. The arm-fire device according to claim 1, wherein a portion where the first and second contact points are in contact with each other is made of a metal material.

9. The arm-fire device according to claim 4, wherein the stator, the proof mass and the elastic member are formed of the same material.

10. The arm-fire device according to claim 1, wherein the through bulkhead initiator includes:

a donor holder formed at the space separated from the ignition portion by the bulkhead;

an acceptor holder formed at the space where the ignition portion is provided;

a donor portion installed in the donor holder and provided with a low energy exploding foil initiator (LEFFI) fired by the firing signal; and an acceptor portion installed in the acceptor holder, and fired by receiving a shock wave due to firing of the donor portion through the bulkhead, and wherein the low energy exploding foil initiator is fired by a voltage of 1000V.

11. The arm-fire device according to claim 10, wherein the through bulkhead initiator is provided with an insertion hole at a center thereof, into which the donor portion is inserted, and further includes an adaptor detachably formed in the donor holder by a spiral portion formed on an outer surface thereof, and the donor holder is provided with a spiral on an inner side surface thereof for coupling with the spiral portion.

12. The arm-fire device according to claim 10, wherein the acceptor portion is made of CH-6.

13. The arm-fire device according to claim 10, wherein the through bulkhead initiator is provided with a notch formed on at least one surface of the bulkhead initiator, and further includes a cover installed in the bulkhead to cover the ignition portion, and configured to hermetically seal the ignition portion.

14. The arm-fire device according to claim 10, wherein the through bulkhead initiator further includes a detachment layer inserted between the acceptor portion and the ignition portion, and configured to block a reciprocal chemical reaction between the acceptor portion and the ignition portion.

15. The arm-fire device according to claim 1, wherein the through bulkhead initiator further includes an ignition portion case installed in the bulkhead, for inserting the ignition portion thereto.

16. The arm-fire device according to claim 15, wherein the ignition portion case includes:

a cup portion formed to fill the ignition portion inside an opening formed at one side thereof; and a sealing portion for sealing the opening, wherein a notch is formed at a part of outer surfaces of the ignition portion case.

* * * * *